US008092233B1

(12) United States Patent
Lee et al.

(10) Patent No.: US 8,092,233 B1
(45) Date of Patent: Jan. 10, 2012

(54) STACKED MULTILAYER CONNECTOR

(75) Inventors: Ipson Lee, Taoyuan County (TW); Andy Chen, Taipei County (TW)

(73) Assignee: Super Link Electronics Co., Ltd., Taoyuan County (TW)

( * ) Notice: Subject to any disclaimer, the term of this patent is extended or adjusted under 35 U.S.C. 154(b) by 37 days.

(21) Appl. No.: 12/843,270

(22) Filed: Jul. 26, 2010

(51) Int. Cl.
*H01R 24/00* (2006.01)

(52) U.S. Cl. ..... 439/74; 439/631

(58) Field of Classification Search ..... 439/65, 439/74, 631, 636, 540.1, 541.5
See application file for complete search history.

(56) References Cited

U.S. PATENT DOCUMENTS 6,695,622 B2 * 2/2004 Korsunsky et al. ..... 439/65
7,044,748 B2 * 5/2006 Korsunsky et al. ..... 439/74
7,045,891 B2 * 5/2006 Choi ..... 257/723
7,108,567 B1 * 9/2006 Korsunsky et al. ..... 439/701
7,445,467 B1 * 11/2008 Matsuo ..... 439/74
7,677,903 B1 * 3/2010 Huang et al. ..... 439/74
7,726,979 B2 * 6/2010 Lei et al. ..... 439/74
7,798,819 B2 * 9/2010 Kudo et al. ..... 439/74

* cited by examiner

*Primary Examiner* — Thanh Tam Le
(74) *Attorney, Agent, or Firm* — Rosenberg, Klein & Lee

(57) ABSTRACT

A stacked multilayer connector includes two seat bodies oppositely disposed on a circuit board and two connection seats. Multiple electronic card units can be previously held between the connection seats as stacked layers and then the connection seats with the electronic card units can be plugged into the seat bodies into electrical contact with the circuit board. Each seat body has multiple terminal passageways in which multiple first terminals are inlaid. Each connection seat has multiple terminal passages in which multiple second terminals are inlaid. Each second terminal has multiple electronic card contact sections for clamping the electronic card units and a contact arm for contacting with the first terminal. The contact arm of the second terminal is a projection below the electronic card contact sections, whereby the width of the insulation main body of the connection seat is reduced to minify the required installation space and lower manufacturing cost.

6 Claims, 10 Drawing Sheets

STACKED MULTILAYER CONNECTOR

BACKGROUND OF THE INVENTION

1. Field of the Invention

The present invention relates to a stacked multilayer connector, and more particularly to a multilayer connector including two seat bodies and two connection seats. Multiple electronic card units can be previously held between the connection seats as stacked layers and then the connection seats with the electronic card units can be plugged into the seat bodies.

2. Description of the Prior Art

An existent stacked connector for connecting with multiple layers of electronic card units includes a pair of seat bodies and multiple pairs of connection seats. The seat bodies are oppositely soldered on a circuit board. An electronic card unit is previously held between a pair of connection seats and then the connection seats with the electronic card unit are plugged into the seat bodies or a lower pair of connection seats. Accordingly, the connection seats that hold the electronic card units are insert-connected and stacked layer by layer to connect the electronic card units with the circuit board.

Referring to FIG. 10, multiple first terminals 51 are inlaid in each seat body 50 of the conventional stacked connector. Each first terminal 51 has a first contact section 511 extending into an insertion slot 52 of top end of the seat body 50. Multiple second terminals 61 are inlaid in the connection seat 60. Each second terminal 61 has a front section as an electronic card contact section 61*a*. The electronic card contact section 61*a* has a rear end, which lengthwise rearward extends from the electronic card contact section 61*a*. The second terminal 61 further has a second contact section 61*b* and a third contact section 61*c*. The second contact section 61*b* upward projects from the rear end of the electronic card contact section 61*a*. The third contact section 16*c* downward projects from the rear end of the electronic card contact section 61*a*. When the connection seat 60 is correspondingly plugged into the insertion slot 52 of the seat body 50, the third contact section 61*c* comes into contact with the first contact section 511 of the first terminal 51. Alternatively, when the connection seat 60 is correspondingly plugged into the insertion slot 621 of a lower layer of connection seat 60, the third contact section 61*c* comes into contact with the second contact section 61*b* of the second terminal 61 of the lower layer of connection seat 60.

According to the aforesaid, the conventional stacked connector has the following shortcomings:

1. The connection seats 60 can only hold one single electronic card unit. When installing two or more layers of electronic card units, it is necessary to insert-connect and stack the same number of pairs of connection seats 60 layer by layer. Therefore, the different layers of connection seats 60 and the seat bodies 50 contact each other at numerous contact points. As a result, in use, the connection seats 60 tend to loosen from each other to cause poor contact.

2. The second and third contact sections 61*b*, 61*c* of the second terminal 61 of the connection seat 60 lengthwise and rearward extend from the electronic card contact section 61*a*. Therefore, the insulation main body 62 of the connection seat 60 must have a considerable length for fully enclosing the second terminal 61. Consequently, the connection seat 60 has a large volume and necessitates a large installation space. This increases the manufacturing cost and makes it difficult to apply the stacked connector to a lightweight and slim electronic product.

SUMMARY OF THE INVENTION

It is therefore a primary object of the present invention to provide a stacked multilayer connector, in which the connection seat is connected with the seat body at only one contact point. Therefore, the number of the contact points of the stacked multilayer connector is greatly reduced to minimize the possibility of loosening and poor contact in use.

It is a further object of the present invention to provide the above stacked multilayer connector, in which the volume of the connection seat is reduced to minify the required installation space and lower manufacturing cost. In this case, the stacked multilayer connector is applicable to lighter and slimmer electronic product.

To achieve the above and other objects, the stacked multilayer connector of the present invention includes: two seat bodies oppositely disposed on a circuit board, each seat body having a main body section, a top face of the main body section being recessed to form a lengthwise connection slot, the main body section being further formed with multiple terminal passageways, a first terminal being inlaid in each of the terminal passageways, the first terminal having a projecting contact section extending into the connection slot of the main body section, a bottom section of the first terminal being soldered onto the circuit board; and two connection seats for holding opposite sides of multiple electronic card units in electrical contact with the contacts of the electronic card units. Each of the connection seats is formed with multiple sockets, whereby multiple electronic card units can be inserted into the sockets and stacked between the two connection seats and electrically connected with the connection seats. Each connection seat has an insulation main body. A bottom section of the insulation main body is formed with a projecting guide tenon, which can be correspondingly plugged into the connection slot of the seat body. The insulating main body is further formed with multiple terminal passages in which multiple second terminals are respectively correspondingly inlaid. Each of the second terminals has a contact arm extending along a lateral side of the guide tenon, whereby when the guide tenon is correspondingly inserted into the connection slot of the seat body, the contact arm comes into contact with one side of the contact section of the first terminal of the seat body. Each of the second terminals further has multiple electronic card contact sections in the form of stacked layers, the electronic card contact sections extending into the corresponding sockets respectively for contacting with multiple corresponding electronic card units layer by layer. Accordingly, multiple electronic card units can be previously held by means of the two connection seats and then the connection seats with the electronic card units can be plugged into the seat bodies at one time. In contrast, in the conventional multilayer electronic card connector, the connection seats must be insert-connected layer by layer and this often causes poor contact between the layers. Moreover, in the present invention, the contact arm of the second terminal is a projection below the electronic card contact sections. Due to such special structure, the width of the insulation main body of the connection seat can be reduced to minify the required installation space and lower manufacturing cost. Accordingly, the stacked multilayer connector of the present invention is applicable to lighter and slimmer electronic product.

According to the aforesaid, the stacked multilayer connector of the present invention has the following advantages:

1. In the stacked multilayer connector of the present invention, the connection seat is connected with the seat body at only one contact point. Therefore, the number of insert connection points of the stacked multilayer connector is greatly reduced to minimize the possibility of poor contact. In contrast, in the conventional multilayer electronic card connector, the connection seats must be insert-connected layer by layer and this often leads to poor contact between the layers.

2. In the stacked multilayer connector of the present invention, the volume of the connection seat is reduced to minify the required installation space and lower manufacturing cost. Accordingly, the stacked multilayer connector of the present invention is applicable to lighter and slimmer electronic product.

The present invention can be best understood through the following description and accompanying drawings, wherein:

DETAILED DESCRIPTION OF THE PREFERRED EMBODIMENTS

Figure 1:
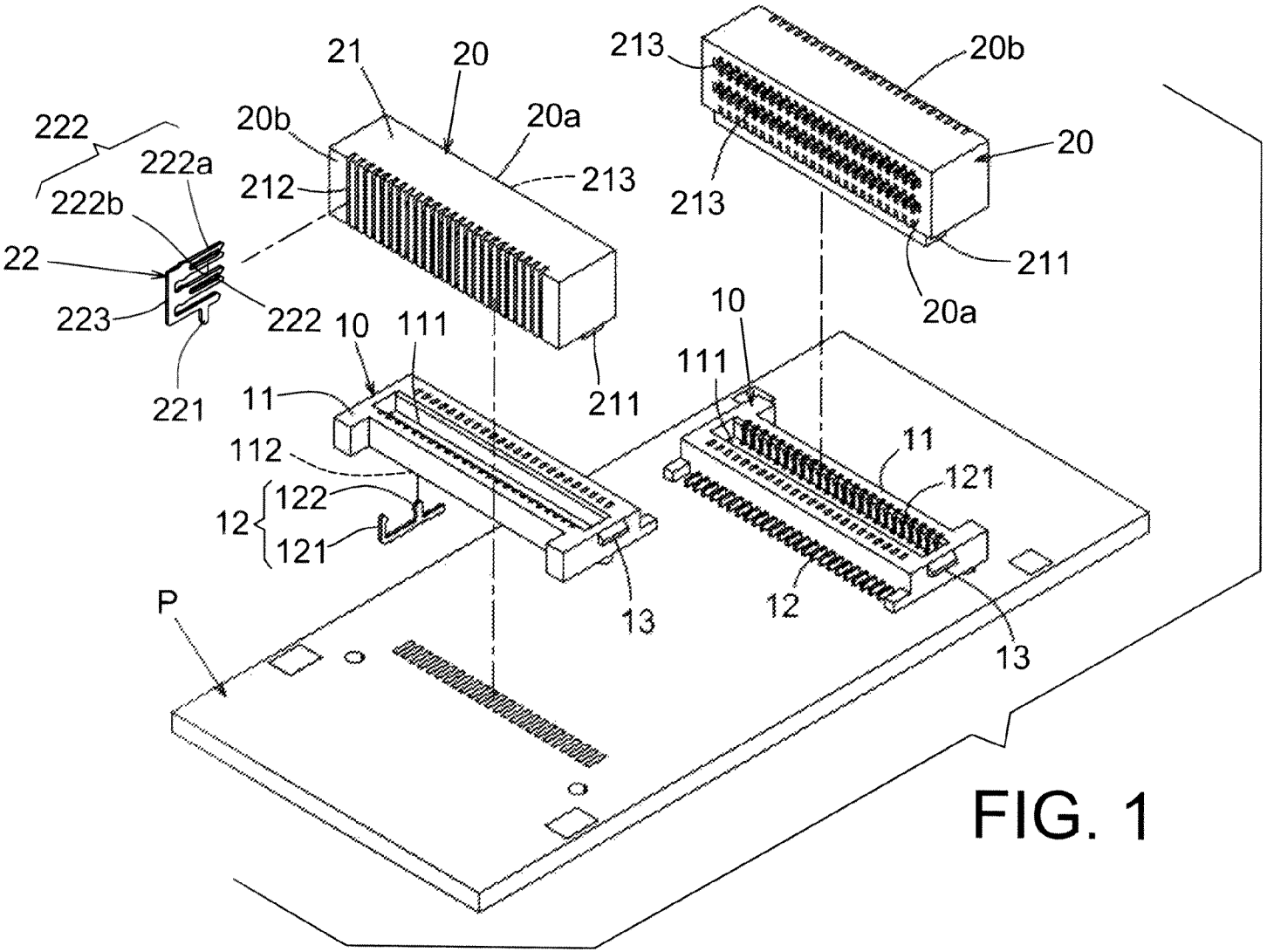
FIG. 1 is a perspective exploded view of the present invention.
Figure 2:
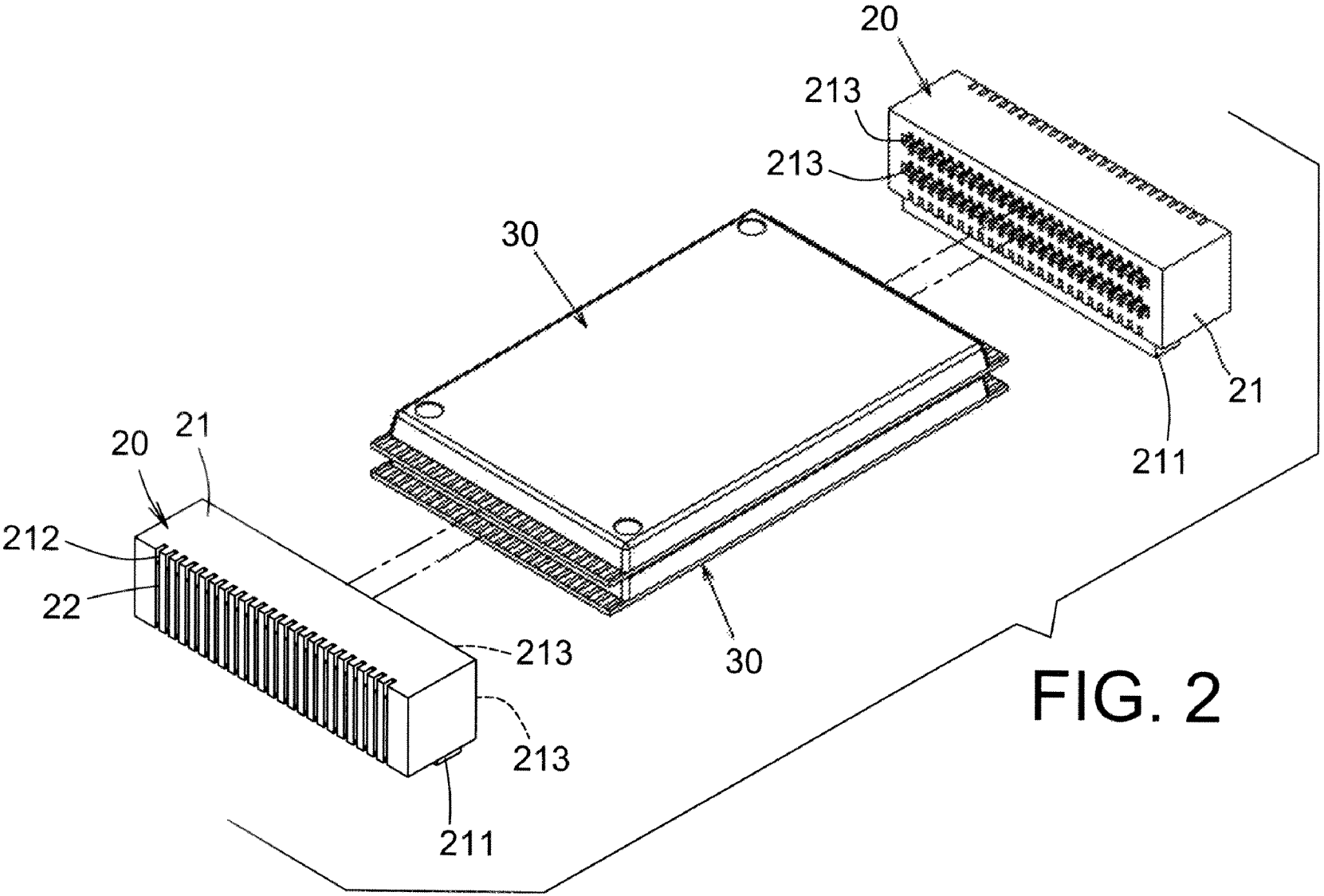
FIG. 2 is a perspective view showing that multiple electronic card units are held between two connection seats of the present invention.
Figure 3:
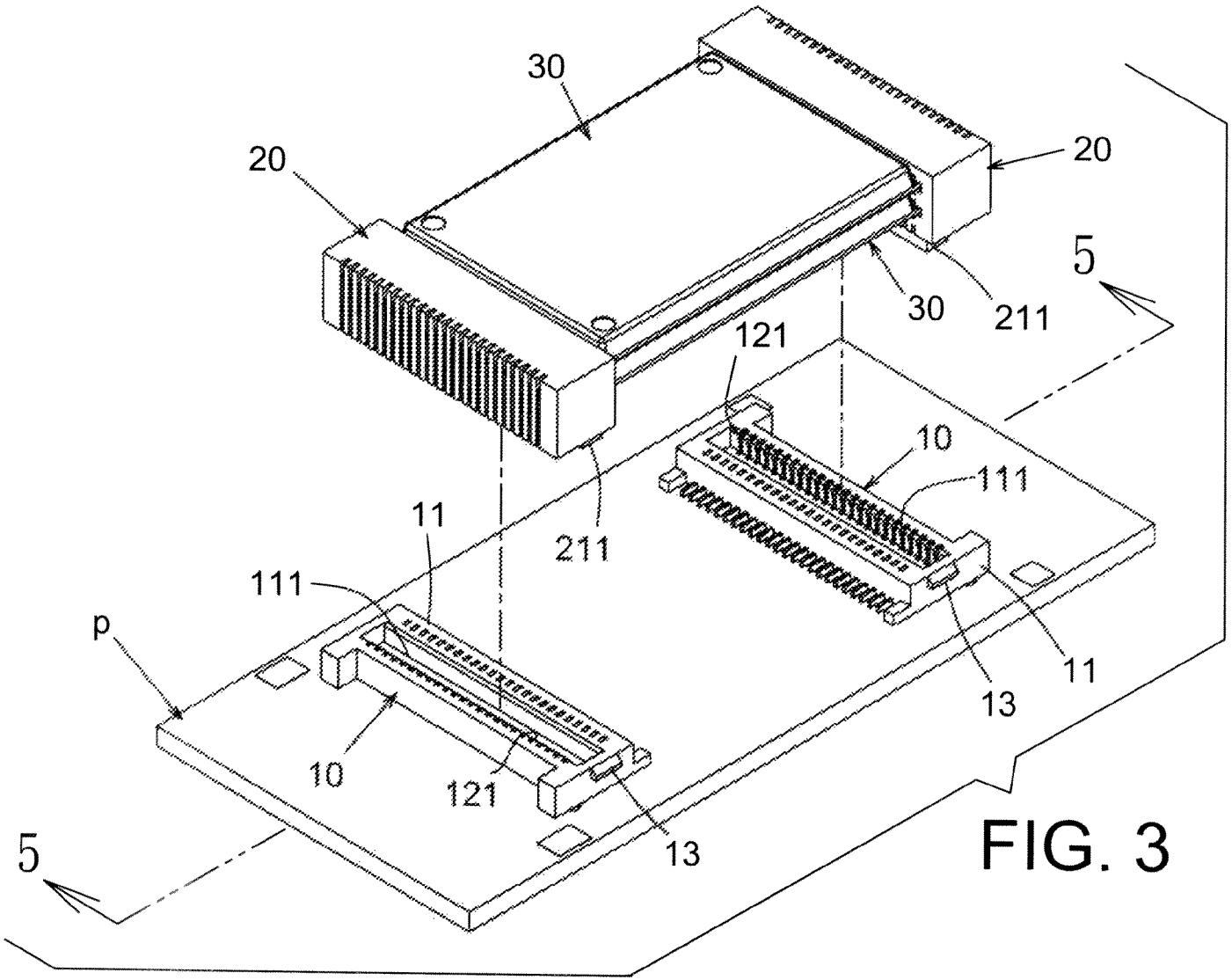
FIG. 3 is a perspective view showing that the connection seats with the electronic card units are to be plugged into the seat bodies of the present invention.
Figure 4:
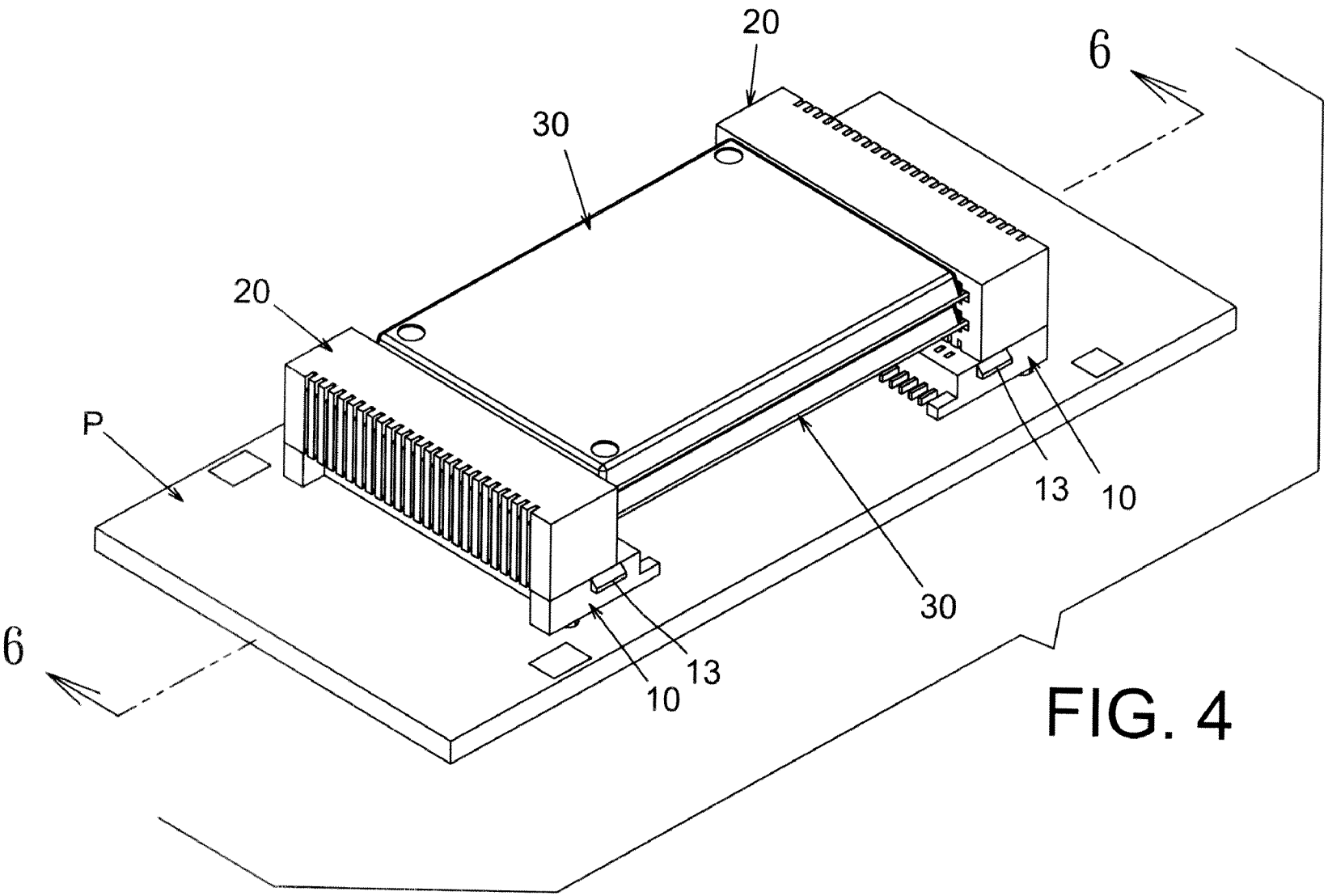
FIG. 4 is a perspective assembled view according to FIG. 3, showing that the connection seats with the electronic card units are plugged in the seat bodies of the present invention.

Please refer to FIGS. 1 to 6. The stacked multilayer connector of the present invention includes two seat bodies 10 oppositely disposed on a circuit board P. Each seat body 10 has a main body section 11. A top face of the main body section 11 is recessed to form a lengthwise connection slot 111. In addition, the main body section 11 is formed with multiple terminal passageways 112 (with reference to FIG. 5). A first terminal 12 is inlaid in each of the terminal passageways 112. The first terminal 12 has a projecting contact section 121 extending into the connection slot 111 of the main body section 11. The bottom section of the first terminal 12 is soldered onto the circuit board P. The stacked multilayer connector of the present invention further includes two connection seats 20. Each of the connection seats 20 is formed with multiple, that is, two or more, sockets 213. The two connection seats 20 serve to hold opposite sides of multiple electronic card units 30 in electrical contact with the contacts of the electronic card units 30. Each connection seat 20 has an insulation main body 21. The bottom section of the insulation main body 21 is formed with a projecting guide tenon 211, which can be correspondingly plugged into the connection slot 111 of the seat body 10. In addition, the insulating main body 21 is formed with multiple terminal passages 212 in which multiple second terminals 22 are respectively correspondingly inlaid. Each second terminal 22 has a contact arm 221 extending along a lateral side of the guide tenon 211. When the guide tenon 211 is correspondingly inserted into the connection slot 111 of the seat body 10, the contact arm 221 will come into contact with one side of the contact section 121 of the first terminal 12 of the seat body 10. In addition, each second terminal 22 has multiple electronic card contact sections 222 in the form of stacked layers. The electronic card contact sections 222 extend into the corresponding sockets 213 respectively for contacting with multiple corresponding electronic card units 30 layer by layer. Accordingly, multiple electronic card units 30 can be previously held by means of the two connection seats 20 and then the connection seats 20 with the electronic card units 30 can be plugged into the seat bodies 10 at one time. In contrast, in the conventional multilayer electronic card connector, the connection seats must be insert-connected layer by layer and this often causes poor contact between the layers. In the present invention, the contact arm 221 of the second terminal 20 is a projection below the electronic card contact sections 222. Thanks to such special structure, the width of the insulation main body 21 of the connection seat 20 can be reduced to minify the required installation space and decrease manufacturing cost. Accordingly, the stacked multilayer connector of the present invention is applicable to lighter and slimmer electronic product.

Figure 5:
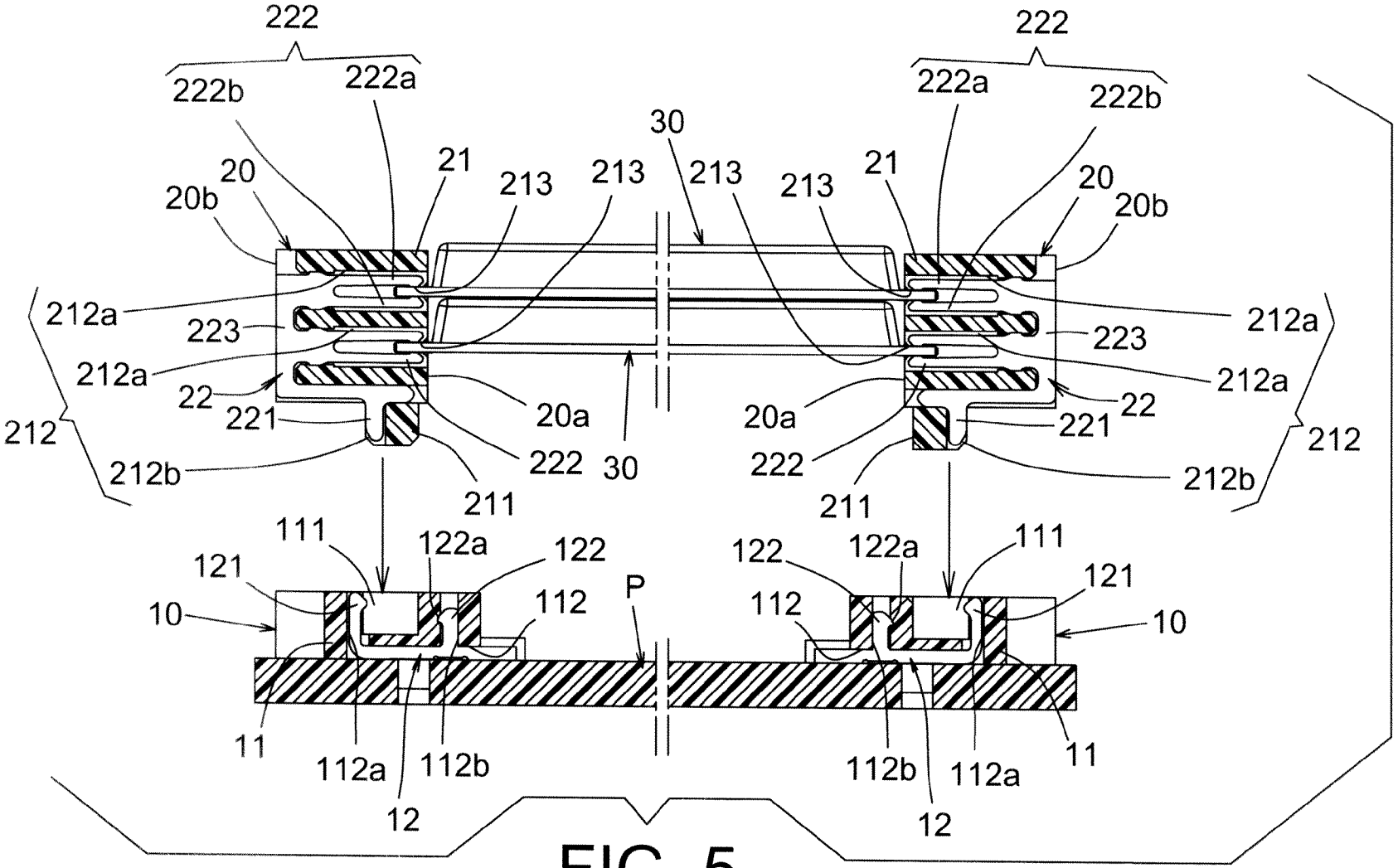
FIG. 5 is a sectional view taken along line 5-5 of FIG. 3.
Figure 6:
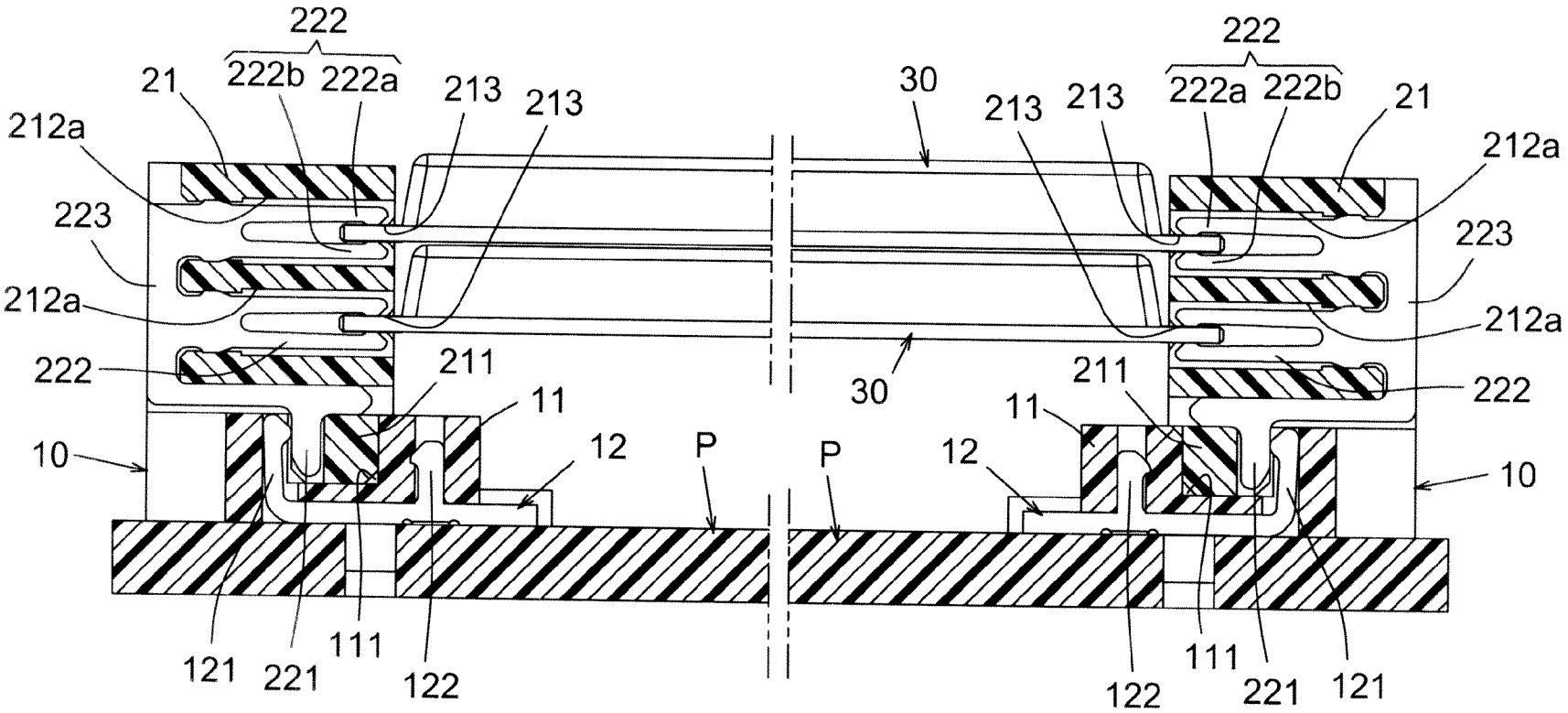
FIG. 6 is a sectional view taken along line 6-6 of FIG. 4.

Please refer to FIGS. 1, 5 and 6. In the stacked multilayer connector of the present invention, the bottom of the main body section 11 of the seat body 10 is formed with multiple recessed terminal passageways 112 in parallel to each other. Each terminal passageway 112 has a channel 112*a* extending to the connection slot 111 and at least one insertion hole 112*b*. Each first terminal 12 has a perpendicularly projecting contact section 121 and a perpendicularly projecting insertion tongue 122. The contact section 121 extends through the channel 112*a* into the connection slot 111. The insertion tongue 122 is tightly inlaid in the insertion hole 112*b*. The insertion tongue 122 has a latch tooth 122*a* projecting from one side of the insertion tongue 122. The latch tooth 122*a* serves to securely bite at the wall of the insertion hole 112*b* so as to prevent the first terminal 12 from slipping out of the terminal passageway 112.

The insulation main body 21 of the connection seat 20 has an inner side 20*a* and an outer side 20*b*. The inner side 20*a* of the insulation main body 21 is formed with multiple layers of sockets 213 for inserting electronic card units 30 therein respectively. The outer side 20*b* of the insulation main body 21 is formed with multiple terminal passages 212 in parallel to each other. Each terminal passage 212 has multiple layers of electronic card contact section holes 212*a* for correspondingly inserting the electronic card contact sections 222 of the second terminal 22 therein. The electronic card contact section holes 212*a* respectively communicate with the corresponding layers of sockets 213 of the insulation main body 21, whereby the respective layers of electronic card contact sections 222 of the second terminal 22 can extend into the corresponding layers of sockets 213. The terminal passage 212 further has a contact channel 212*b* formed on the outer side 20*b* of the insulation main body 21 and extending from the outer side 20*b* to a lateral side of the guide tenon 211. Accordingly, the contact arm 221 of the second terminal 22 can extend to the lateral side of the guide tenon 211 of the insulation main body 21.

Figure 10:
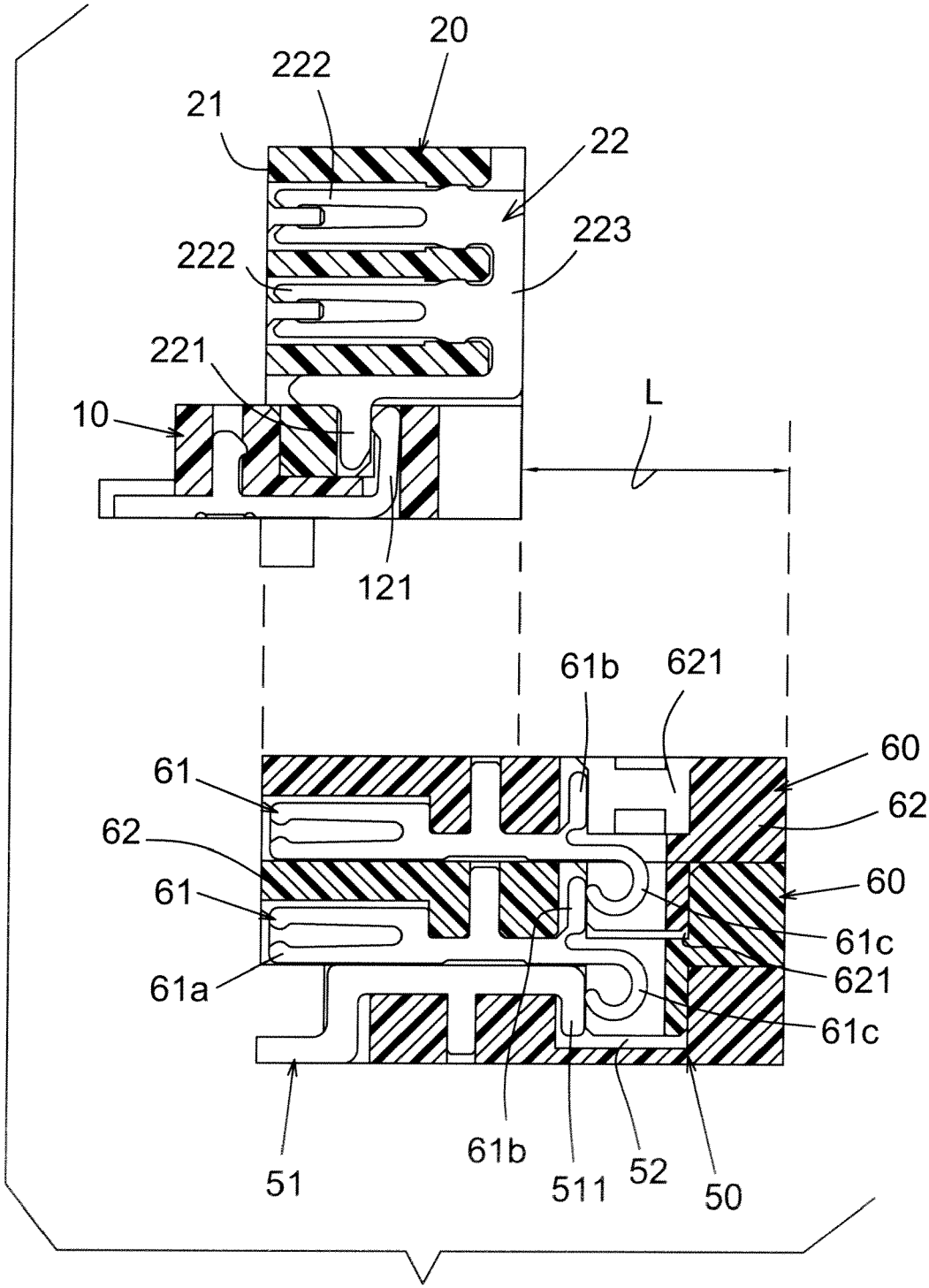
FIG. 10 is a sectional view, in which the stacked multilayer connector of the present invention is compared with a conventional stacked connector.

Please refer to FIG. 10, in which the present invention (upper side of the drawing) is compared with the conventional stacked connector (lower side of the drawing). In the present invention, the second terminal 22 has a base section 223. The electronic card contact sections 222 and the contact arm 221 of the second terminal 22 project from the base section 223 to the same side. According to such arrangement, the contact arm 221 of the second terminal 20 is a projection below the electronic card contact sections 222. Thanks to this special structure, the width of the insulation main body 21 for enclosing the second terminal 22 can be greatly reduced. In comparison with the connection seat 20 of the present invention, the insulation main body 62 of the connection seat 60 of the conventional stacked connector has a much larger width for enclosing the second and third contact sections 61*b*, 61*c* that rearward extend from the electronic card contact section 61*a* of the second terminal 61. Therefore, the insulation main body 21 of the connection seat 20 of the present invention has a width smaller than that of the insulation main body 62 of the conventional connection seat 60 by a length L as shown in FIG. 10. In this case, the amount of the material of the stacked multilayer connector of the present invention is reduced to lower manufacturing cost. Moreover, the required installation space is greatly reduced, whereby the stacked multilayer connector of the present invention is applicable to lighter and slimmer electronic product.

Figure 7:
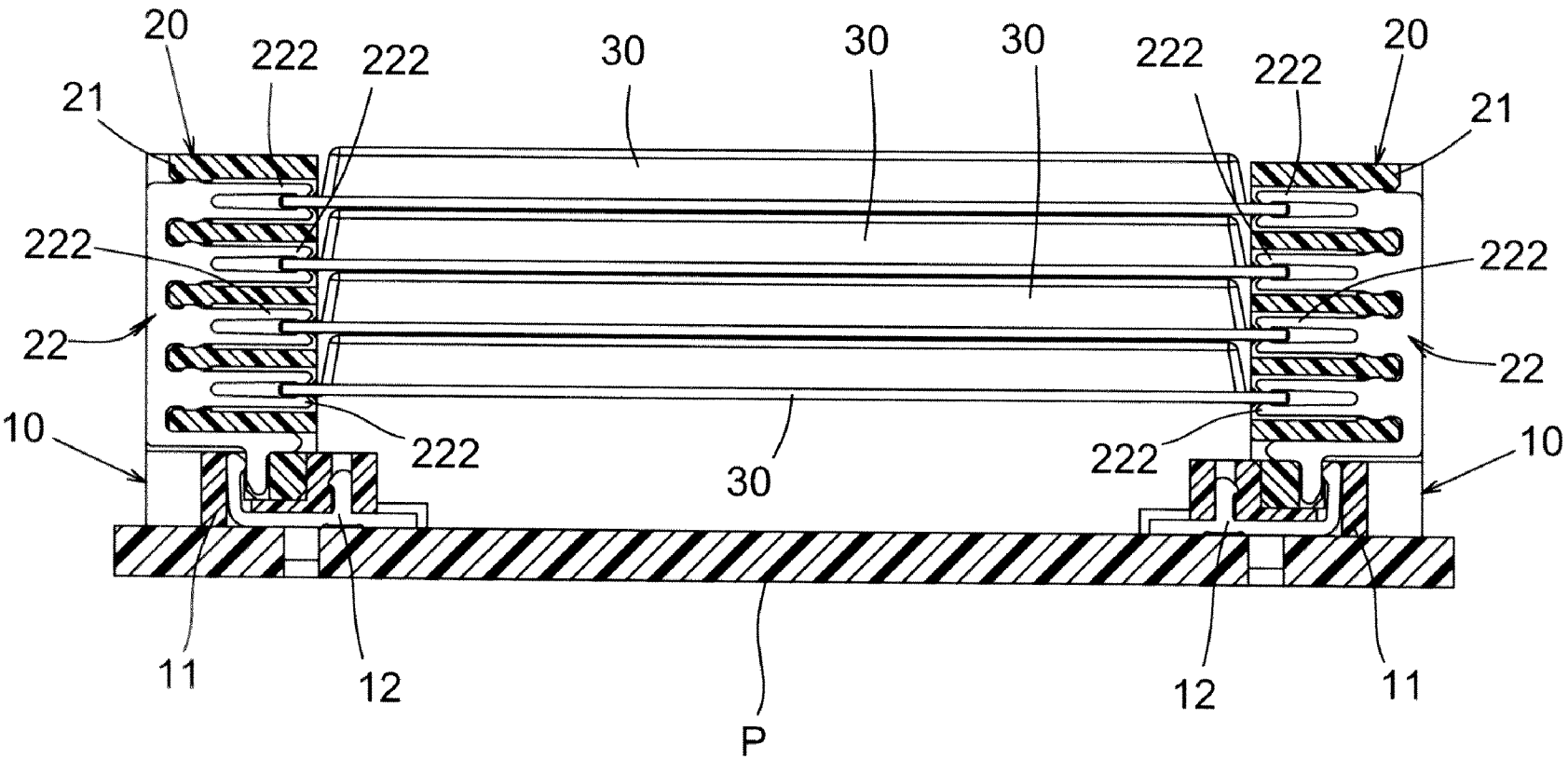
FIG. 7 is a sectional view according to FIG. 6, in which the second terminal of the present invention has four electronic card contact sections.

In the stacked multilayer connector of the present invention, the second terminal 22 can have two layers of electronic card contact sections 222 as shown in FIG. 5 or four layers of electronic card contact sections 222 as shown in FIG. 7. The number of the electronic card contact sections 222 of the second terminal is not specifically limited. As shown in FIG. 5, the electronic card contact section 222 of the second terminal 22 has a first clamping arm 222*a* and a second clamping arm 222*b*. The electronic card unit 30 can be inserted and tightly held between the first and second clamping arms 222*a*, 222*b*.

Figure 8:
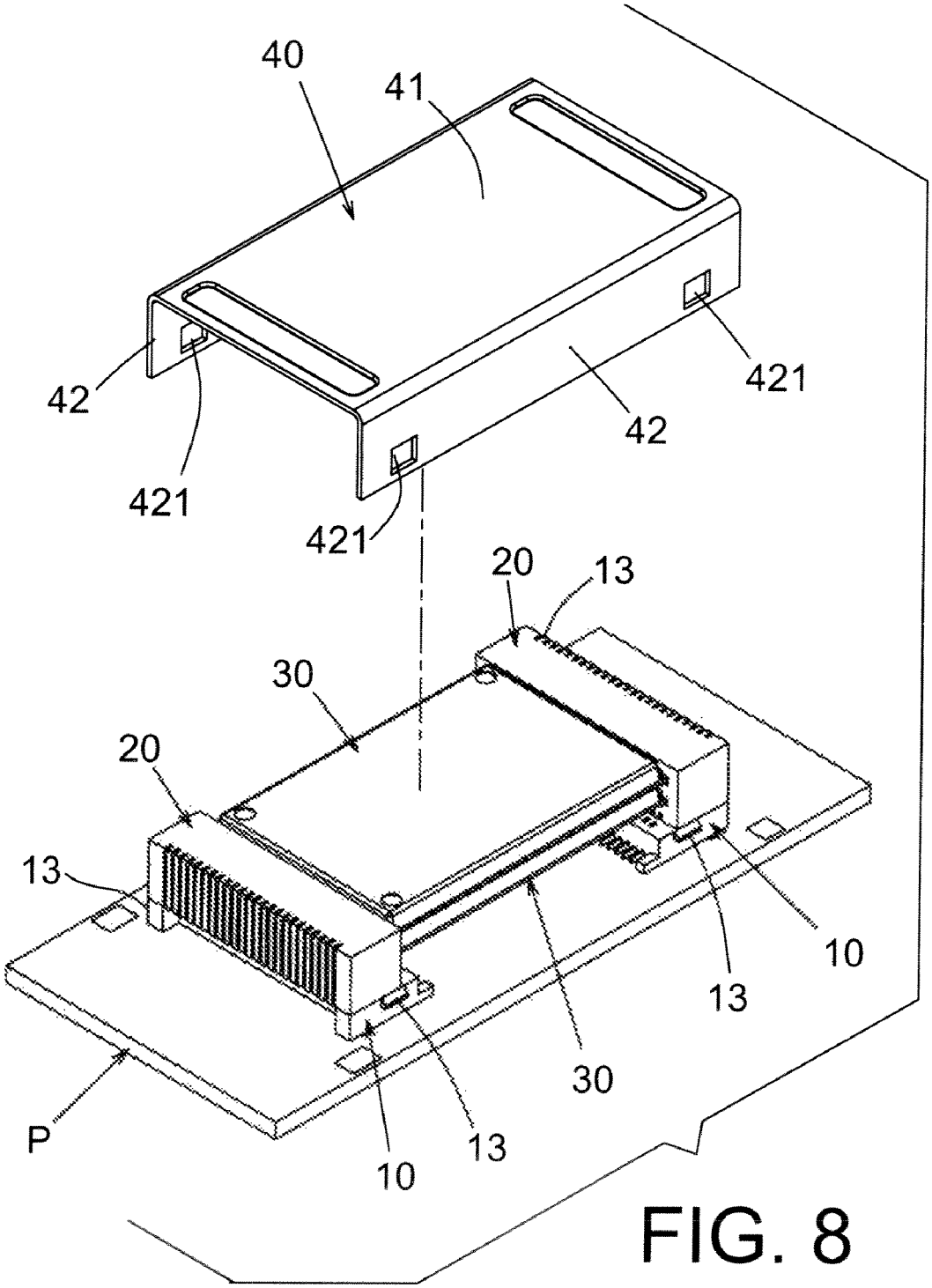
FIG. 8 is a perspective view showing that a secure cover is to be assembled with the stacked multilayer connector of the present invention.
Figure 9:
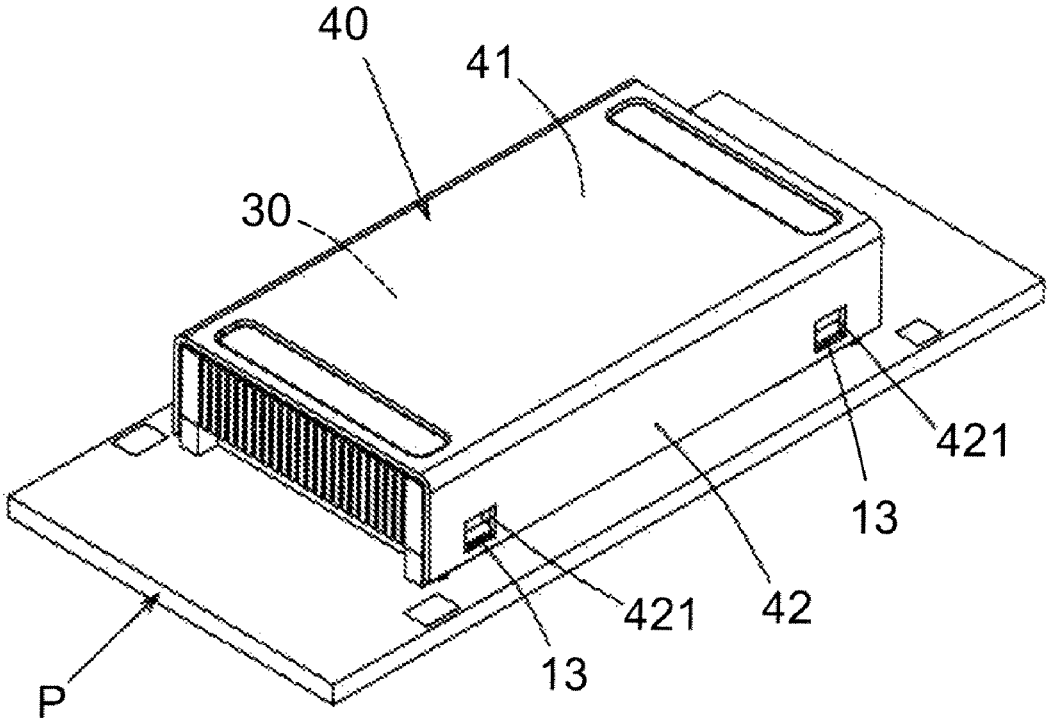
FIG. 9 is a perspective view according to FIG. 8, showing that the secure cover is assembled with the stacked multilayer connector of the present invention.

Referring to FIGS. 8 and 9, the stacked multilayer connector of the present invention further includes a secure cover 40 having a board section 41 and two sidewalls 42. The sidewalls 42 respectively perpendicularly project from two opposite sides of the board section 41. Each sidewall 42 has a latch section 421 and each seat body 10 has a buckle section 13. The latch sections 421 of the sidewalls 42 of the secure cover 40 can be latched with the buckle sections 13 of the seat bodies 10 to affix the secure cover 40 to the seat bodies 10. Under such circumstance, the secure cover 40 can enclose therein the electronic card units 30 between the connection seats 20 to shield the electronic card units 30 from electromagnetic interference from ambient environment.

According to the above arrangement, the stacked multilayer connector of the present invention has the following advantages:

1. In the stacked multilayer connector of the present invention, the connection seat 20 is connected with the seat body 10 at only one contact point. Therefore, the number of insert connection points of the stacked multilayer connector is greatly reduced to minimize the possibility of poor contact. In contrast, in the conventional multilayer electronic card connector, the connection seats must be insert-connected layer by layer and this often leads to poor contact between the layers.

2. In the stacked multilayer connector of the present invention, the volume of the connection seat 20 is reduced to minify the required installation space and lower manufacturing cost.

3. In the stacked multilayer connector of the present invention, a connection seat 20 with a different number of layers of sockets can be selectively used in accordance with different requirement of different manufacturer or user.

The above embodiments are only used to illustrate the present invention, not intended to limit the scope thereof. Many modifications of the above embodiments can be made without departing from the spirit of the present invention.

What is claimed is:

1. A stacked multilayer connector comprising:

(a) two seat bodies oppositely disposed on a circuit board, each seat body having a main body section, a top face of the main body section being recessed to form a lengthwise connection slot, the main body section being further formed with multiple terminal passageways, a first terminal being inlaid in each of the terminal passageways, the first terminal having a projecting contact section extending into the connection slot of the main body section, a bottom section of the first terminal being soldered onto the circuit board; and (b) two connection seats, each of the connection seats being formed with multiple sockets, whereby multiple electronic card units can be inserted into the sockets and stacked between the two connection seats and electrically connected with the connection seats, each connection seat having an insulation main body, a bottom section of the insulation main body being formed with a projecting guide tenon, which can be correspondingly plugged into the connection slot of the seat body, the insulating main body being further formed with multiple terminal passages in which multiple second terminals are respectively correspondingly inlaid, each of the second terminals having a contact arm extending along a lateral side of the guide tenon, whereby when the guide tenon is correspondingly inserted into the connection slot of the seat body, the contact arm comes into contact with one side of the contact section of the first terminal of the seat body, each of the second terminals further having multiple electronic card contact sections in the form of stacked layers, the electronic card contact sections extending into the corresponding sockets respectively for contacting with multiple corresponding electronic card units layer by layer.

2. The stacked multilayer connector as claimed in claim 1, wherein a bottom of the main body section of the seat body is formed with multiple recessed terminal passageways in parallel to each other, each terminal passageway having a channel extending to the connection slot and at least one insertion hole, each first terminal having a perpendicularly projecting contact section and a perpendicularly projecting insertion tongue, the contact section extending through the channel into the connection slot, the insertion tongue being tightly inlaid in the insertion hole.

3. The stacked multilayer connector as claimed in claim 2, wherein the insertion tongue has a latch tooth projecting from one side of the insertion tongue.

4. The stacked multilayer connector as claimed in claim 1, wherein the insulation main body of the connection seat has an inner side and an outer side, the inner side of the insulation main body being formed with multiple layers of sockets for inserting the electronic card units therein respectively, the outer side of the insulation main body being formed with multiple terminal passages in parallel to each other, each terminal passage having multiple layers of electronic card contact section holes for correspondingly inserting the electronic card contact sections of the second terminal therein, the electronic card contact section holes respectively communicating with the corresponding layers of sockets of the insulation main body, whereby the respective layers of electronic card contact sections of the second terminal can extend into the corresponding layers of sockets, the terminal passage further having a contact channel formed on the outer side of the insulation main body and extending from the outer side to a lateral side of the guide tenon, whereby the contact arm of the second terminal can extend to the lateral side of the guide tenon of the insulation main body.

5. The stacked multilayer connector as claimed in claim 1, wherein the second terminal has a base section, the electronic card contact sections and the contact arm of the second terminal projecting from the base section to the same side.

6. The stacked multilayer connector as claimed in claim 1, further comprising a secure cover having a board section and two sidewalls, the sidewalls respectively perpendicularly projecting from two opposite sides of the board section, each sidewall having a latch section and each seat body having a buckle section, the latch sections of the sidewalls of the secure cover being latched with the buckle sections of the seat bodies to affix the secure cover to the seat bodies, whereby the secure cover can enclose therein the electronic card units between the connection seats.

* * * * *